US005550464A

United States Patent [19]

Lorenz

[11] Patent Number: 5,550,464

[45] Date of Patent: Aug. 27, 1996

[54] CURRENT SWITCH WITH BUILT-IN CURRENT SOURCE

[75] Inventor: Perry S. Lorenz, Sunnyvale, Calif.

[73] Assignee: National Semiconductor Corporation, Del.

[21] Appl. No.: 213,911

[22] Filed: Mar. 15, 1994

[51] Int. Cl.[6] ..... G05F 3/26

[52] U.S. Cl. ..... 323/315; 327/538

[58] Field of Search ..... 323/315, 316, 323/317, 907, 284, 351, 312; 327/538, 543

[56] References Cited

U.S. PATENT DOCUMENTS

| | | | |
|---|---|---|---|
| 3,787,734 | 1/1974 | Dorler et al. | 307/203 |
| 4,602,208 | 7/1986 | Hines | 323/317 |
| 5,347,210 | 9/1994 | Nguyen | 323/315 |

OTHER PUBLICATIONS

National Semiconductor, LM6118/LM6218A/LM6218 Fast Settling Dual Operational Amplifier; pp. 3–666 through 3–674.

Frank Goodenough, Wideband IC Amps Reach New Bandwidth Highs, Electronic Design, pp. 49 through 66, Sep. 2, 1993.

*Primary Examiner*—Peter S. Wong
*Assistant Examiner*—Adolf Berhane
*Attorney, Agent, or Firm*—Limbach & Limbach L.L.P.

[57] ABSTRACT

A current switch receives a differential voltage. The differential voltage has one of first and second polarities. The current switch provides an output current at a first output if the differential voltage has the first polarity and provides the output current at a second output if the differential voltage has the second polarity. An input stage receives the differential voltage. First and second switches are coupled to the input stage, and a resistor is coupled between the first and second switches. A voltage differential is maintained across the resistor, which induces a current in the resistor. The first switch provides the current to the first output responsive to the differential voltage having the first polarity and the second switch provides the current to the second output responsive to the differential voltage having the second polarity.

6 Claims, 2 Drawing Sheets

CURRENT SWITCH WITH BUILT-IN CURRENT SOURCE

TECHNICAL FIELD OF THE INVENTION

The invention relates to a current switch, in particular to a current switch with a "built-in" current source.

BACKGROUND OF THE INVENTION

A conventional current switch circuit is shown in FIG. 1. The circuit 10 has two inputs, inn and inp for receiving a differential voltage. For the purposes of description throughout this specification, including in the claims, when the voltage at the inp input is higher than the voltage at the inn input, the differential voltage is deemed to have a positive polarity. By contrast, when the voltage at the inn input is higher than the voltage at the inp input, the differential voltage is deemed to have a negative polarity.

As further shown in FIG. 1, in the current switch circuit 10, the base of a first PNP input transistor Q1 is coupled to receive the inn input, and the collector of the first PNP input transistor Q1 is coupled to the $V_{EE}$ power rail. Similarly, the base of a second PNP input transistor Q2 is coupled to receive the inp input; the collector of the second PNP input transistor Q2 is also coupled to the $V_{EE}$ power rail.

A pair of input clamp diodes D9 and D10, connected in parallel in opposing polarity, couple the emitters of the first and second PNP input transistors Q1, Q2. Thus, the emitters of the first and second PNP input transistors Q1, Q2 are never more than one diode in voltage apart. That is, provided a large enough differential voltage at the inn and inp inputs, only one of the PNP input transistors Q1, Q2 is on at any one time.

The emitter of the first PNP input transistor Q1 is voltage coupled to the base of a first NPN switch transistor Q3 through a first voltage biasing diode D7. A first biasing current I1, provided from a second biasing current source transistor Q121, which is coupled to the anode of first voltage biasing diode D7, ensures that the first voltage biasing diode D7 and the first input transistor Q1 remain conducting. The collector of the first NPN switch transistor Q3 is coupled to the $V_{CC}$ power supply rail.

In a similar fashion, the emitter of the second PNP input transistor Q2 is voltage coupled to the base of a second NPN switch transistor Q4 through a second voltage biasing diode D8. A second biasing current 12, provided from a second biasing current source transistor Q120, which is coupled to the anode of second voltage biasing diode D8, ensures that the second voltage biasing diode D8 and the second input transistor Q2 remain conducting.

The emitters of the first and second NPN switch transistors Q3, Q4 are coupled together to receive a first switch current 13, from a first switch current sink transistor Q132. The collector of the second NPN switch transistor Q4 is coupled to sink the first switch current 13 from a first switch output OUT1 when the voltage across its base-emitter junction is such that second NPN switch transistor Q4 is conducting. Otherwise, the collector of the first NPN switch transistor Q3 is coupled to the $V_{CC}$ rail to provide a path for the first switch current 13 when the voltage across its base-emitter junction is such that the first NPN switch transistor Q3 is conducting. As will be discussed in detail below, only one of the NPN switch transistors Q3, Q4 is conducting at any one time.

As further shown in FIG. 1, the emitter of the first PNP input transistor Q1 is also voltage coupled to the base of a first PNP switch transistor Q5 through the first voltage biasing diode D7. The collector of the first PNP switch transistor Q5 is coupled to the $V_{EE}$ power supply rail. Similarly, the emitter of the second PNP input transistor Q2 is voltage coupled to the base of a second PNP switch transistor Q6 through the second voltage biasing diode D8.

The emitters of the first and second PNP switch transistors Q5, Q6 are coupled together to receive a second switch current I4 from a second switch current source transistor Q124. The collector of the second PNP switch transistor Q6 is coupled to sink the second switch current 14 from a second output OUT2 when the voltage across its base-emitter junction is such that second PNP switch transistor Q6 is conducting. Otherwise, the collector of the first PNP switch transistor Q5 is coupled to the $V_{EE}$ rail to provide a path for the second switch current I4 when the voltage across its base-emitter junction is such that the first PNP switch transistor Q5 is conducting. As will be discussed in detail below, only one of the PNP switch transistors Q5, Q6 is conducting at any one time.

Furthermore, only one of the second NPN switch transistor Q4 and the second PNP switch transistor Q6 is conducting at any one time.

The conventional circuit 10 operates generally as follows. In response to a differential voltage applied to the differential inputs inn, inp, a voltage difference is formed across the clamp diodes D9, D10. For ease of discussion, voltage differences will herein be referred to by the number of "diode" drops or increases.

Taking first the case where the differential voltage has a positive polarity (i.e. when the voltage at the inp input is higher than the voltage at the inn input), the second input transistor Q2 is off. Thus, the emitter of the second input transistor Q2 is one diode (across the second clamp diode D10) above the emitter of the first input transistor Q1, or two diodes above the input inn. Furthermore, the base of the second NPN switch transistor Q4 is one more diode drop (across the second voltage biasing diode D8), or three diode drops above the input inn.

The base of the first input NPN switch transistor Q3 is one diode (across the first voltage biasing diode D7) above the emitter of the PNP input transistor Q1, or two diodes above the inn input. The emitter of the first NPN switch transistor Q3 is also at two diodes above the inn input. Therefore, the first NPN switch transistor Q3 is off.

The second NPN switch transistor Q4, however, has its base at two diode drops from the emitter of the first input transistor Q1 (or three diodes above the inn input and its emitter at one diode from the emitter of the first input transistor Q1 (or two diodes above the inn input. Thus, the current I3 is sunk from the first switch output OUT1.

By contrast, the second PNP switch transistor Q6 is off, so the both the base and the emitter of the second PNP switch transistor Q6 are at three diodes above the inn input.

The first PNP switch transistor Q5 is on, and it conducts the current I4 to the $V_{EE}$ rail.

In the case where the differential voltage has a negative polarity (i.e. when the voltage at the inn input is higher than the voltage at the inp input), the first input transistor Q1 is off. Thus, the emitter of the first input transistor Q1 is one diode (across the first clamp diode D9) above the emitter of the second input transistor Q2, or two diodes above the inp input. Furthermore, the base of the first NPN switch transistor Q3 is one more diode drop (across the first voltage biasing diode D7), or three diodes above the inp input.

The base of the second PNP switch transistor Q4 is one diode drop (across the second voltage biasing diode D8) from the emitter of the second PNP input transistor Q2, or two diodes above the inp input. Since the second NPN switch transistor Q4 is off, the emitter of the second NPN switch transistor Q4 is also at two diodes above the inp input.

The first NPN switch transistor Q3, however, has its base at three diodes above the inp input and its emitter at two diodes above the inp input. Thus, the current I3 is conducted to the $V_{CC}$ rail.

By contrast, the first PNP switch transistor Q5 is off, so the both the base and the emitter of the first PNP switch transistor Q5 are at three diodes above the inp input.

The second PNP switch transistor Q6 is on, and it sources the current I4 into the OUT2 output.

The conventional current switch circuit 10 has the problem that the capacitances associated with the switch current source transistors Q132 and Q124 slow the switching speed of the switch transistors Q3, Q4, Q5, and Q6.

Furthermore, it is desirable to provide a current switch which requires fewer current sources and less circuitry.

SUMMARY OF THE INVENTION

In accordance with the present invention, a current switch is provided that receives a differential voltage, where the differential voltage has one of first and second polarities. The current switch provides a current at a first output if the differential voltage has the first polarity and provides the current at a second output if the differential voltage has the second polarity.

The current switch comprises receiving means for receiving the differential voltage, a first switch coupled to the receiving means, and a second switch coupled to the receiving means. A resistor is coupled between the first and second switches, and a voltage differential is maintained across the resistor.

The first switch provides the current to the first output responsive to the differential voltage having the first polarity and the second switch provides the current to the second output responsive to the differential voltage having the second polarity.

A better understanding of the features and advantages of the invention will be obtained by reference to the following detailed description and accompanying drawings which set forth an illustrative embodiment in which the principles of the invention are utilized.

DETAILED DESCRIPTION

Figure 1:
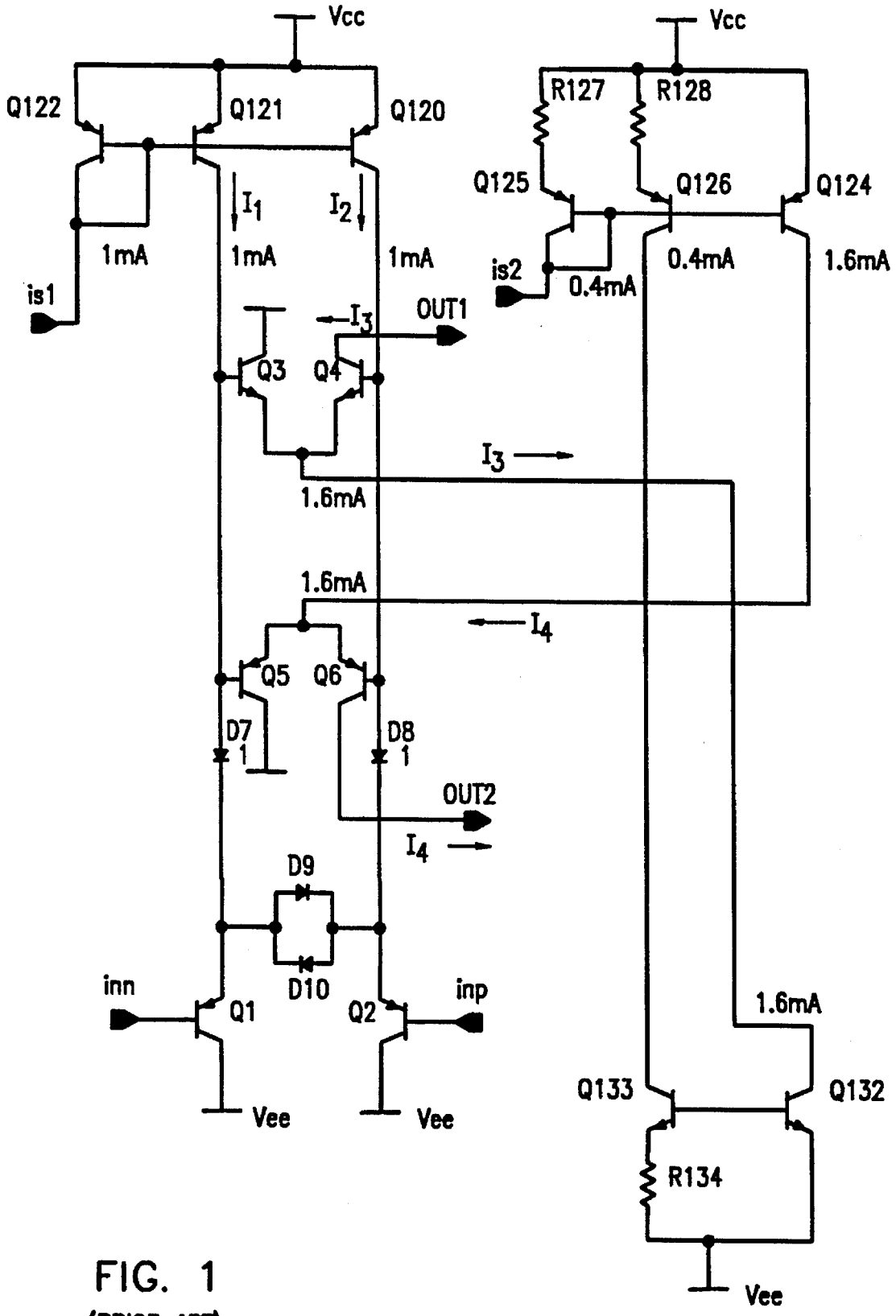
FIG. 1 (PRIOR ART)
FIG. 1 shows a conventional current switch circuit.

The invention will now be described with reference to FIG. 2. Where the components are the same as those of FIG. 1, they are given the same designations.

Figure 2:
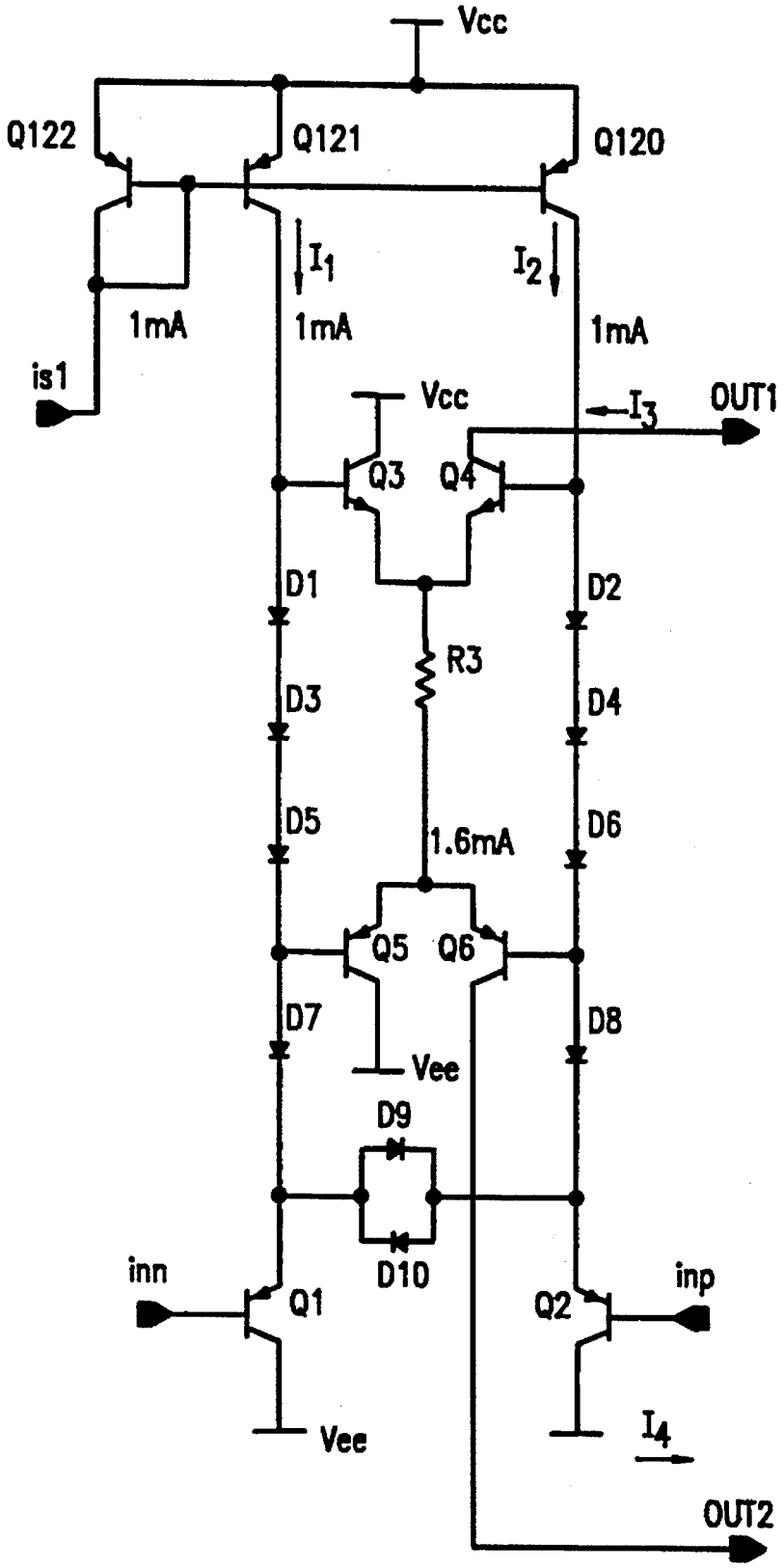
FIG. 2 shows a switch circuit accordance with the present invention.

FIG. 2 shows a switch circuit in accordance with the present invention. In the circuit of FIG. 2, a number of diodes D1, D3, D5 are interposed between the base of the first PNP switch transistor Q5 and the base of the first NPN switch transistor Q3. The diodes, biased on by the first biasing current source I1, serve to maintain a voltage difference between the base of the first PNP switch transistor Q5 and the base of the first NPN switch transistor Q3. In addition, a number of other diodes D2, D4, D6 are interposed between the base of the second PNP switch transistor Q6 and the base of the second NPN switch transistor Q4. The diodes, biased on by the second biasing current source I2, serve to maintain a voltage difference between the base of the second PNP switch transistor Q6 and the base of the second NPN switch transistor Q4.

In addition, in place of the switch current source I3 coupled to the emitters of the first and second NPN switch transistors Q3, Q4, and the switch current source I4 coupled to the emitters of the first and second PNP switch transistors Q5, Q6, a resistor R3 is connected between the coupled emitters of the first and second NPN switch transistors Q3, Q4 and the coupled emitters of the first and second PNP switch transistors Q5, Q6.

As discussed above, whether the polarity of the differential input voltage is positive or negative, the coupled emitters of the first and second PNP switch transistors Q5, Q6 are at two diodes above the emitter of the PNP input transistor that is on (i.e three diodes above the inn or inp inputs).

However, whereas in the conventional current switch circuit the coupled emitters of the first and second NPN switch transistors Q3, Q4 were at two diodes above the inn input or the inp input with the addition of the diodes D1, D3, D5 and D2, D4, D6, the coupled emitters of the switch circuit in accordance with the present invention, the coupled emitters of the first and second NPN switch transistors are now at five diodes above the inn or inp input. Thus, the voltage difference of two diodes induces a "built-in" current through the resistor R3, obviating the need for the first and second switch current sources I3, I4.

Since there is insignificant capacitance associated with the resistor R3, them is no slowing of the switching speed of the switch transistors Q3, Q4, Q5, and Q6.

Furthermore, the switch circuit in accordance with the present invention has fewer current sources and less circuitry than the conventional current switch circuit.

It should be understood that various alternatives to the embodiments of the invention described herein may be employed in practicing the invention. It is intended that the following claims define the scope of the invention and that methods and apparatus within the scope of these claims and their equivalents be covered thereby.

What is claimed is:

1. A current switch that receives a differential voltage, the differential voltage having one of first and second polarities, and provides an output current at a first output if the differential voltage has the first polarity and provides the output current at a second output if the differential voltage has the second polarity, comprising:

an input stage that receives the differential voltage;

a first switch coupled to the input stage;

a second switch coupled to the input stage;

a resistor coupled between said first and second switches; and means for maintaining a voltage differential across the resistor, the voltage differential inducing a current in the resistor wherein the first switch provides the induced current, as the output current, to the first output responsive to the differential voltage having the first polarity and the second switch provides the current to the second output, as the output current, responsive to the differential voltage having the second polarity.

2. The current switch according to claim 1, wherein the input stage comprises first and second PNP transistors coupled to receive the differential voltage at their bases and to provide the received differential voltage at their emitters.

3. The current switch according to claim 2, further comprising:

voltage clamp means interposed between the input stage and the first and second switches for clamping the received differential voltage to art amount equal to a voltage across one diode.

4. A current switch that receives a differential voltage, the differential voltage having one of first and second polarities, and provides an output current at a first output if the differential voltage has the first polarity and provides the output current at a second output if the differential voltage has the second polarity, comprising:

an input stage that receives the differential voltage;

first and second PNP emitter-coupled transistors, the bases of which are respectively coupled to receive the differential voltage from the input stage, the collector of the first PNP transistor being coupled to a power supply lower rail and the collector of the second PNP transistor being coupled to the second output;

first and second NPN emitter-coupled transistors, the collector of the first NPN transistor being coupled to a power supply upper rail and the collector of the second NPN transistor being coupled to the first output;

first means for maintaining a constant voltage difference between the base of the first NPN transistor and the base of the first PNP transistor;

second means for maintaining a constant voltage difference between the base of the second NPN transistor and the base of the second PNP transistor; and a resistor coupled between the coupled emitters of the first and second NPN transistors and the coupled emitters of the first and second PNP transistors whereby a current is induced in the resistor due to a voltage difference between the coupled emitters of the first and second NPN transistors and the coupled emitters of the first and second PNP transistors, and the current is passed to one of the first and second outputs depending on whether the differential voltage received by said receiving means is of the first or second polarity.

5. The current switch of claim 4, wherein the first means is a first plurality of diodes and the second means is a second plurality of diodes.

6. The current switch of claim 5, further comprising:

a first biasing current source coupled to the first plurality of diodes; and a second biasing current source coupled to the second plurality of diodes.

* * * * *

UNITED STATES PATENT AND TRADEMARK OFFICE

CERTIFICATE OF CORRECTION

PATENT NO. : 5,550,464
DATED : August 27, 1996
INVENTOR(S) : PERRY SCOTT LORENZ

It is certified that error appears in the above-indentified patent and that said Letters Patent is hereby corrected as shown below:

In Col. 5, line 9, delete "art" and replace with --an--.

Signed and Sealed this

Twenty-sixth Day of November 1996

*Attest:*

Bruce Lehman

BRUCE LEHMAN

*Attesting Officer*

*Commissioner of Patents and Trademarks*